US010517794B2

(12) United States Patent
Duncan

(10) Patent No.: US 10,517,794 B2
(45) Date of Patent: Dec. 31, 2019

(54) LOW EMF HALOGEN TUBE HEATER

(71) Applicant: Sauna Works Inc., Berkeley, CA (US)

(72) Inventor: Raleigh Duncan, Berkeley, CA (US)

(73) Assignee: SAUNA WORKS INC., Berkeley, CA (US)

( * ) Notice: Subject to any disclaimer, the term of this patent is extended or adjusted under 35 U.S.C. 154(b) by 152 days.

(21) Appl. No.: 15/226,756

(22) Filed: Aug. 2, 2016

(65) Prior Publication Data

US 2016/0338905 A1 Nov. 24, 2016

Related U.S. Application Data

(63) Continuation-in-part of application No. 13/427,899, filed on Mar. 23, 2012, now Pat. No. 9,844,100.

(60) Provisional application No. 62/200,077, filed on Aug. 2, 2015.

(51) Int. Cl.

| | |
|---|---|
| ***H05B 6/02*** | (2006.01) |
| ***A61H 33/06*** | (2006.01) |
| ***H05B 3/00*** | (2006.01) |
| ***H05B 6/44*** | (2006.01) |
| *H05B 11/00* | (2006.01) |
| *F26B 19/00* | (2006.01) |

(52) U.S. Cl.

CPC ..... *A61H 33/063* (2013.01); *H05B 3/008* (2013.01); *H05B 6/44* (2013.01)

(58) Field of Classification Search

CPC ..... H05B 6/44; H05B 3/0038; H05B 3/0052; H05B 3/0076; H05B 3/008; H05B 3/009; H05B 3/04; H05B 3/145; H05B 3/148; H05B 3/44; H05B 3/82; A61H 33/063

USPC ..... 219/220, 462.1, 463.1, 464.1, 486, 507, 219/470, 522, 600; 392/355, 407, 416

See application file for complete search history.

(56) References Cited

U.S. PATENT DOCUMENTS

| | | | | |
|---|---|---|---|---|
| 2,416,977 | A | 3/1947 | Brown et al. | |
| 5,023,433 | A | 6/1991 | Gordon | |
| 5,296,686 | A | 3/1994 | Ullrich et al. | |
| 5,761,377 | A | 6/1998 | Wolfe et al. | |
| 9,844,100 | B2 | 12/2017 | Duncan et al. | |
| 2003/0031471 | A1 | 2/2003 | Schneider et al. | |
| 2006/0289463 | A1 | 12/2006 | Kil | |
| 2007/0110413 | A1* | 5/2007 | Konishi | F24C 7/065 392/407 |
| 2009/0279879 | A1 | 11/2009 | Zenteno et al. | |
| 2010/0072892 | A1* | 3/2010 | Watanabe | H01J 5/38 313/579 |
| 2012/0241440 | A1 | 9/2012 | Duncan et al. | |

(Continued)

FOREIGN PATENT DOCUMENTS

| | | | |
|---|---|---|---|
| JP | 58008673 | A | 1/1983 |

OTHER PUBLICATIONS

"Advisory Action", Advisory Action U.S. Appl. No. 13/427,899, dated Sep. 27, 2016, 3 pages.

(Continued)

*Primary Examiner* — Hung D Nguyen

(74) *Attorney, Agent, or Firm* — Kwan & Olynick LLP

(57) ABSTRACT

A sauna heater, comprising two halogen tubes powered by alternating current, wired up in such a way that the current going through one halogen tube is opposite in phase from the current going through the other halogen tube, wherein the halogen tubes are parallel and close together so that the EMF emitted by the halogen tubes is canceled out.

4 Claims, 4 Drawing Sheets

(56) References Cited

U.S. PATENT DOCUMENTS

| | | | | |
|---|---|---|---|---|
| 2013/0187066 | A1 | 7/2013 | Heller et al. | |
| 2014/0374403 | A1* | 12/2014 | Smith | H05B 3/148 219/522 |
| 2018/0063898 | A1 | 3/2018 | Duncan et al. | |

OTHER PUBLICATIONS

"U.S. Appl. No. 13/427,899, Advisory Action dated Jun. 8, 2017", 3 pages.
"U.S. Appl. No. 13/427,899, Final Office Action dated Mar. 31, 2017", 8 pages.
"Final Office Action", Final Office Action, U.S. Appl. No. 13/427,899, dated Aug. 24, 2015, 6 pages.
"Non-Final Office Action", Non-Final Office Action, U.S. Appl. No. 13/427,899, dated Feb. 12, 2015, 5 pages.
U.S. Appl. No. 15/806,262, Non-Final Office Action dated Jun. 20, 2018, 9 pages.
U.S. Appl. No. 15/806,262, Final Office Action dated Jan. 17, 2019, 16 pages.
"U.S. Appl. No. 13/427,899, Notice of Allowance dated Aug. 8, 2017", 5 pgs.
"Int'l Application Serial No. PCT/US17/45171, Int'l Search Report and Written Opinion dated Oct. 12, 2017", 7 pages.

* cited by examiner

LOW EMF HALOGEN TUBE HEATER

CROSS-REFERENCE TO RELATED APPLICATIONS

The present application is a continuation-in-part of application Ser. No. 13/427,899, filed Mar. 23, 2012, and also claims the benefit of Provisional App. No. 62/200,077, both of which applications are herein incorporated by reference.

BACKGROUND

Field of the Invention

The present invention relates generally to heaters, and more particularly to halogen-tube heaters for saunas that emit no or minimal EMF.

Background of the Invention

Halogen tube heaters are widely used in saunas, as they provide a good amount of therapeutic heat while being inexpensive, compact, and having low power consumption. However, one drawback of such heaters is that they emit a high electromagnetic field (EMF).

Electromagnetic waves are generated wherever electricity flows. There has been a suggestion that electromagnetic waves induce anxiety in humans and are harmful to general health. Since sauna heating elements are typically used at close range, electromagnetic emissions are a serious concern. While a metal enclosure (or an enclosure made of another conductive material) can shield the user from electromagnetic waves, such an enclosure would severely lower the heat-generating efficiency of a heating element, which renders it impractical.

A need therefore exists for a halogen tube heater that does not emit a high amount of EMF.

LIST OF FIGURES

SUMMARY OF THE INVENTION

An object of the present invention is to provide a cheap and simple halogen heater for a sauna that emits low or minimal EMF.

The present invention comprises a heater for a sauna, wherein the heater comprises a first halogen tube and a second halogen tube, both powered by alternating current, where the current powering the first halogen tube is opposite in phase from the current powering the second halogen tube. The distance between the halogen tubes is less than 4 inches, and they are parallel to each other. The tubes are identical in size and power output.

In an embodiment, the tubes are wired together as follows. Each tube comprises a first end and a second end. The first end of the first tube is wired up to a source of alternating current. The second end of the first tube is connected to the second end of the second tube. The first end of the second tube is wired up to the source of alternating current. This way, the current going through the second tube is opposite in phase from the current going through the first tube.

In an embodiment, the tubes are wired as follows. The first end of the first tube and the second end of the second tube are wired up to one pole of the source of alternating current, and the second end of the first tube and the first end of the second tube are wired up to the other pole. This way, the current going through the second tube is opposite in phase from the current going through the first tube.

The halogen tubes are preferably touching each other for maximum cancellation of EMF.

In the preferred embodiment, the heater assembly comprises a reflector for reflecting the heat in a desired direction.

DETAILED DESCRIPTION OF THE PREFERRED EMBODIMENT

Figure 1:
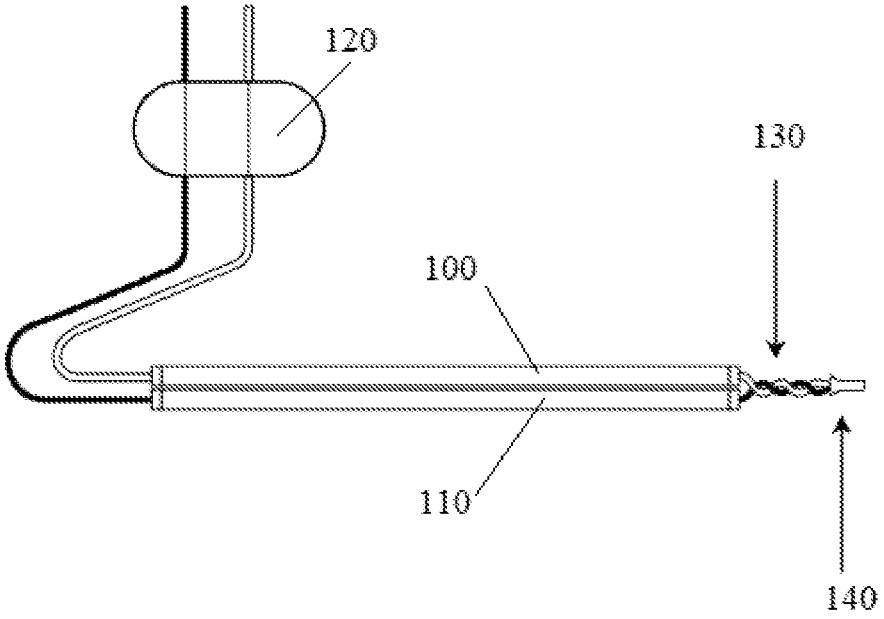
FIG. 1 shows an embodiment of the present invention.

FIG. 1 shows an embodiment of the present invention. Halogen tubes 100 and 110 are wired up to current source 120 as shown in the Figure, connected in series. The ends of the halogen tubes are wired together as shown in the Figure; in the embodiment shown in the Figure, the two wires are twisted together 130 and a wire cap 140 is placed on the twisted ends to insulate the connection. Thus, the current going through the first halogen tube 100 is opposite in phase from the current going through the second halogen tube 110, and the EMF emitted by the first halogen tube 100 is also opposite in phase from the EMF emitted by the second halogen tube 110. If the halogen tubes are identical and placed very close together, that means that the EMF emitted by the two tubes will be cancelled out, resulting in minimal EMF emissions for the whole assembly.

Figure 2:
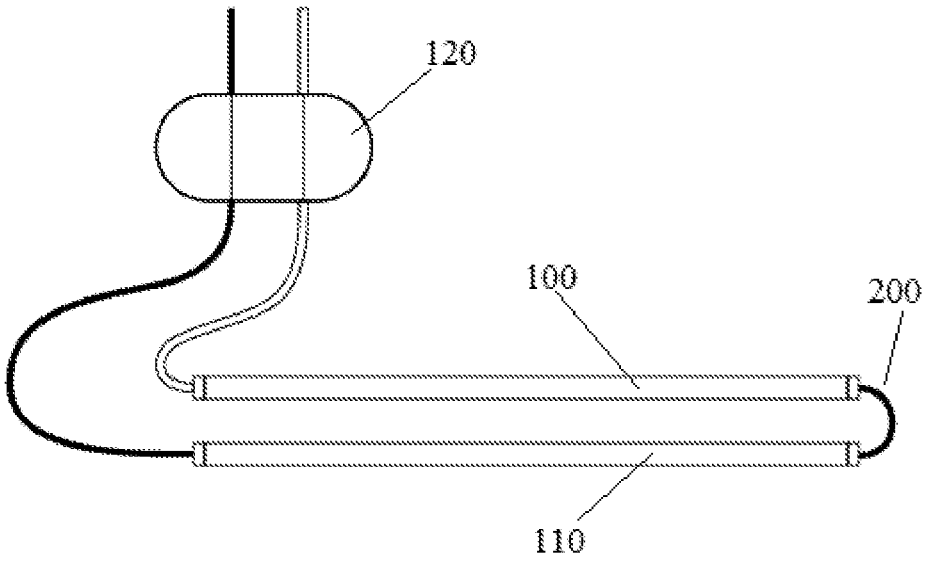
FIG. 2 shows an alternate embodiment of the present invention.

FIG. 2 shows an alternate embodiment of the connection between the two halogen tubes. Rather than a twist connection like the one shown in FIG. 1, a single wire 200 could be used to wire the two ends together.

Figure 3:
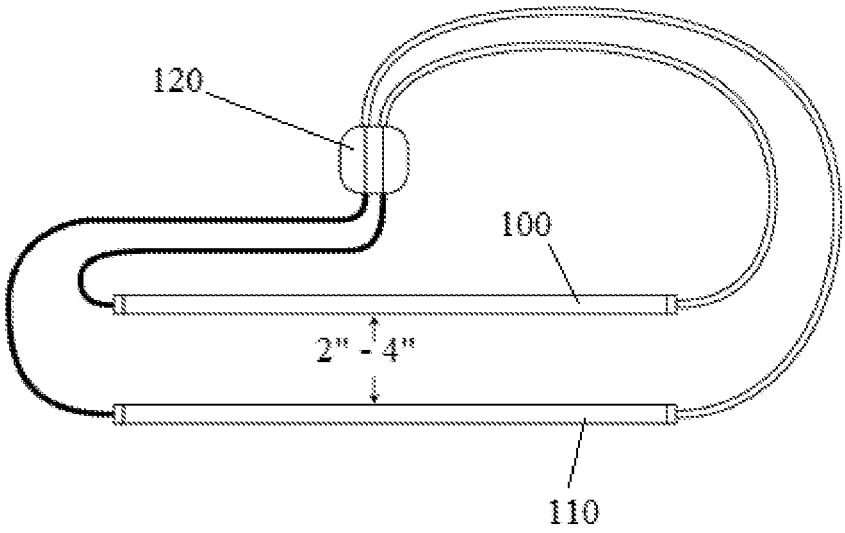
FIG. 3 shows an alternate embodiment of the present invention.

FIG. 3 shows an alternate embodiment of the present invention. In that embodiment, both halogen tubes are connected in parallel to the source of alternating current 120. However, tube 100 is connected to the source of alternating current in one direction and tube 110 is connected in the other direction. This way, the current is still in opposite phases in the two tubes.

Figure 4:
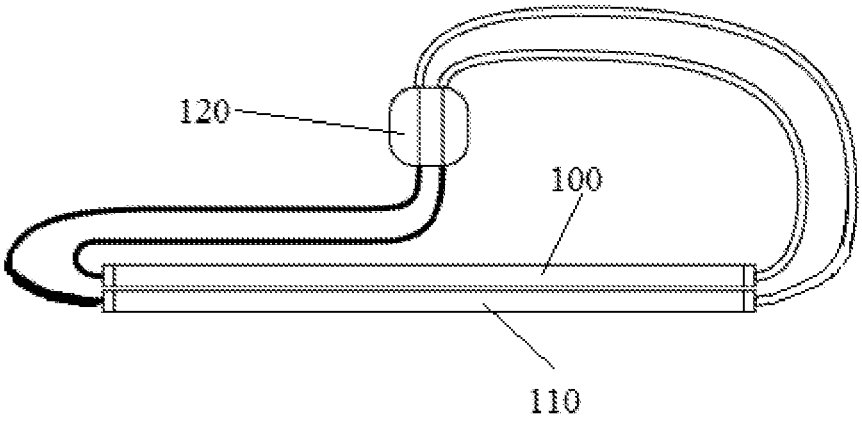
FIG. 4 shows an alternate embodiment of the present invention.

The distance between the tubes in this embodiment, as shown in the figure, is 2"-4". At that distance, the total EMF emitted by the assembly is 20-30 mG. In the preferred embodiment, however, the tubes are touching or nearly touching. When the tubes are touching, the total EMF emitted by the assembly is around 1-5 mG, as shown in FIG. 4.

The tubes are preferably attached to a mounting fixture in such a way as to keep them at the proper distance and the proper relative position to each other. The attachment may be permanent or temporary. In an embodiment, the distance between the halogen tubes may be adjustable to "tune" the amount of EMF emitted by the tubes.

The heater assembly preferably also comprises a reflector to reflect all the heat in the desired direction. The reflector may be a parabolic reflector or any other shape of reflector typically used in a sauna for halogen heaters.

The heater assembly may also comprise electrical shielding to block any remaining EMF from reaching the user. The shielding is preferably metal mesh that does not unduly block heat.

Exemplary embodiments are described above. It will be understood that the present invention comprises other embodiments, and that the invention is only limited by the appended claims.

What is claimed is:

1. A heater for a sauna, said heater comprising:

a first halogen tube;

a second halogen tube parallel to the first halogen tube, wherein a distance between the first and second halogen tube is less than 4 inches, wherein the first halogen tube is the same length as the second halogen tube and the same power as the second halogen tube;

a source of alternating current;

wherein current powering the first halogen tube is 180° out of phase with current powering the second halogen tube, wherein a total electromagnetic field (EMF) emitted by the heater is between 20 and 30 milligauss, and wherein the distance between the first halogen tube and the second halogen tube is configurable to adjust an amount of EMF emitted by the heater.

2. The heater of claim 1, wherein the first halogen tube comprises a first end and a second end, and the second halogen tube comprises a first end and a second end, and wherein the first end of the first halogen tube is closer to the first end of the second halogen tube than it is to the second end of the second halogen tube, further comprising:

an electrical connection from the first end of the first halogen tube to a source of alternating current;

an electrical connection from the second end of the first halogen tube to the second end of the second halogen tube;

an electrical connection from the first end of the second halogen tube to the source of alternating current.

3. The heater of claim 1, wherein the first halogen tube comprises a first end and a second end, and the second halogen tube comprises a first end and a second end, and wherein the source of alternating current has a first pole and a second pole, further comprising:

an electrical connection from the first pole to the first end of the first halogen tube;

an electrical connection from the first pole to the second end of the second halogen tube;

an electrical connection from the second pole to the second end of the first halogen tube;

an electrical connection from the second pole to the first end of the second halogen tube.

4. The heater of claim 1, wherein the first halogen tube is touching the second halogen tube.

* * * * *